US009173040B2

(12) United States Patent
Håkansson

(10) Patent No.: US 9,173,040 B2
(45) Date of Patent: Oct. 27, 2015

(54) MINIATURIZED VARIABLE RELUCTANCE TRANSDUCER

(76) Inventor: Bo Håkansson, Göteborg (SE)

( * ) Notice: Subject to any disclaimer, the term of this patent is extended or adjusted under 35 U.S.C. 154(b) by 203 days.

(21) Appl. No.: 13/813,614

(22) PCT Filed: Aug. 23, 2011

(86) PCT No.: PCT/SE2011/000154
§ 371 (c)(1),
(2), (4) Date: Jan. 31, 2013

(87) PCT Pub. No.: WO2012/030270
PCT Pub. Date: Mar. 8, 2012

(65) Prior Publication Data

US 2013/0129129 A1 May 23, 2013

(30) Foreign Application Priority Data

Aug. 28, 2010 (SE) ..... 1000876

(51) Int. Cl.
*H04R 25/00* (2006.01)
*H04R 11/02* (2006.01)
*H04R 31/00* (2006.01)

(52) U.S. Cl.
CPC ..... *H04R 25/00* (2013.01); *H04R 11/02* (2013.01); *H04R 25/604* (2013.01); *H04R 25/606* (2013.01); *H04R 31/006* (2013.01); *H04R 2460/13* (2013.01)

(58) Field of Classification Search
CPC ..... H04R 25/00
USPC ..... 381/326, 81, 151
See application file for complete search history.

(56) References Cited

U.S. PATENT DOCUMENTS

| | | | | |
|---|---|---|---|---|
| 2003/0034705 | A1* | 2/2003 | Hakansson | 310/81 |
| 2004/0028249 | A1* | 2/2004 | Asnes | 381/151 |
| 2006/0045298 | A1 | 3/2006 | Westerkull | |
| 2007/0053536 | A1 | 3/2007 | Westerkull | |
| 2009/0064484 | A1 | 3/2009 | Hakansson | |
| 2009/0232345 | A1 | 9/2009 | Takase | |
| 2010/0145135 | A1 | 6/2010 | Ball et al. | |

FOREIGN PATENT DOCUMENTS

| | | | |
|---|---|---|---|
| EP | 0685983 | A2 | 12/1995 |
| SE | 529817 | C2 | 10/2007 |
| WO | WO 0167813 | A1 | 9/2001 |
| WO | WO 03/096744 | A1 | 11/2003 |

OTHER PUBLICATIONS

Bo. E. V. Håkansson. The balanced electromagnetic separation transducer: A new bone conduction transducer. Acoust. Soc. Am., vol. 113, No. 2, Feb. 2003.
International Search Report, Oct. 18, 2011, from International Phase of the instant application.

* cited by examiner

*Primary Examiner* — Duc Nguyen
*Assistant Examiner* — Phan Le
(74) *Attorney, Agent, or Firm* — Jackson Patent Law Office

(57) ABSTRACT

The present invention comprises a new topology of a balanced variable reluctance transducer where magnets are moved to a lateral position relative to the dynamic flux circuit. This makes the whole transducerFIG.considerably smaller and the air gaps become fully visible from the outside.

15 Claims, 5 Drawing Sheets

MINIATURIZED VARIABLE RELUCTANCE TRANSDUCER

TECHNOLOGY AREA

The present invention relates to a new design solution of a sound and vibration generating transducer that has minimal dimensions and where the air gaps can be easily inspected.

BACKGROUND TO THE INVENTION

Bone conduction hearing aids are prescribed to patients who cannot use conventional air conduction hearing aids because of chronic ear infection or a congenital or acquired deformity of the outer and/or middle ear. Sound or vibration generating transducers are used as speakers in such bone conduction hearing aids. Sometimes such transducers are referred to as a bone conduction transducer.

A traditional bone conduction hearing aid consists of a bone conduction transducer contained in a plastic casing which is pressed with a constant pressure of 3-5 Newton against the skin over the bone behind the ear. Microphone, amplifier and battery are placed in a separate enclosure at a safe distance from the transducer to avoid feedback problems. The most significant disadvantages with this type of bone conduction heaing aid are that it is uncomfortable to wear because of the constant pressure against the skin and that the soft skin over the skull impairs the transmission of the vibrations from the transducer to the bone.

Since the early 1980s another type of bone conduction hearing aid was introduced—the bone-anchored hearing aid (BAHA)—where the bone conduction transducer is attached directly to the bone using a skin penetrating bone-anchored titanium implant, e.g. SE8107161, SE9404188 or Tjellström et al. 2001. In this way a bone conduction hearing device could be designed where all components are capsulated in a single housing. This device also offers higher gain and an improved wearing comfort. To improve the BAHA system performance further, a new type of bone conduction transducer was developed called Balanced Electromagnetic Separation Transducer (BEST) which is described in patents U.S. Pat. Nos. 6,751,334, 7,471,801; SE0666843 and Håkansson 2003.

A new generation of bone conduction devices is under development in which a capsuled BEST transducer is completely implanted in the temporal bone and thus the skin and soft tissue can be intact. Both the signal and the energy are here transmitted through the intact skin using an inductive coupling arrangement, as described by Håkansson et al. 2008 and 2010. The benefits of implanting the transducer in the temporal bone, compared with a transducer that is externally worn, are many. Most importantly the permanent skin penetration is not needed which otherwise require daily care and in some cases it suffer from infections and possibly also the entire implant can be lost as a result of such complications. In addition, increased vibration sensitivity is also obtained as the implanted transducer, for anatomical reasons, preferably is placed in the temporal bone closer to the cochlea (Håkansson et al. 2010). Finally, the size of the externally worn sound processor will be smaller (as it do not need to contain the transducer) and the stability margins are improved.

For obvious reasons, it is of utmost importance for a bone conduction transducer in general and implantable transducers in particular to have a high mechanical vibration/sound output, high efficiency, and have a small size. For an implanted transducer where a replacement requires a surgical procedure it is perhaps even more important that the reliability of the transducer is very high and proper function should preferably be life-long. These demands require new solutions as the transducers with today's technology have limitations and shortcomings in most of these respects. Transducers with current technology are too large and may not fit in a large proportion of temporal bones especially in patients with history of the ear infection where the temporal bone has a tendency to significantly deform and shrink in size. It is also widely known that the transducer is the most vulnerable component in today's bone conduction hearing aids. Above all, it is the small and vital air gaps in the transducer that are the main source of these reliability problems.

The primary objective of the present invention is to minimize the BEST transducer in size by means of a new topology without sacrificing vibration output performance. A second objective is to find a design where the air gaps can easily be inspected to ensure the quality of the transducer.

Other applications for bone conduction transducers in addition to hearing aids are for example in communication applications, audiometric testing applications and in vibration testing equipment. The present invention is equally applicable in such applications.

PRIOR ART

A bone conduction transducer in of variable reluctance type that uses a known BEST topology is shown in FIG. 1*a* and *b* (Prior Art), where FIG. 1*a* shows the cross section of the longer side of the transducer, and FIG. 1*b* shows the view of its shorter side. As shown in FIG. 1*a* both the static magnetic flux ($f_{dc}$—solid line) and the dynamic magnetic flux ($f_{ac}$—dashed line) is conducted and floating only in this plane—in what follows also referred to as the "dynamic flux plane". The dynamic magnetic flux generated in the coil carries the audio information which is converted to dynamic forces by the dynamic and static magnetic flux interacting in the air gaps (AG) according to known electromagnetic principles. FIG. 1*a* shows a cross section of the four magnets (M) and the eight air gaps (AG), all of which extends/expands/is stretched out in the normal direction to this plane which is perpendicular to or anti-parallel to the defined dynamic flux plane. FIG. 1*b* shows a view of the transducer from the shorter side where the external yokes (EY) are supported by two support bars (SB) placed lateral (outside) relative to the electro-magnetic circuits that generates the static and dynamic magnetic flux. The electro-magnetic circuits consist of bobbin (B), coil (C), internal yokes (IY), external yokes (EY), magnets (M) and air gaps (AG). In the dynamic flux circuit the dynamic flux is closed through the bobbin (B), internal yokes (IY) and the air gaps (AG) while in the static flux circuit the static flux is closed through magnet (M), air gaps (AG) and internal yokes (IY) and external yokes (EY). The dynamic flux plane and the static flux plane are parallel in the Prior art. External (EY) and internal (IY) yokes, magnets (M) and support bars (SB) forms, altogether, the total counter weight mass which interacts with the suspension spring (S) to create the main transducer resonance which determines the transducer performance at low frequencies. An extra counter weight mass (not shown) can be placed around the transducer in order to increase the counter weight mass and hence lower the resonance frequency and thus improve the low frequency response. As is evident by figures 1*a* and 1*b*the air gaps (AG) are concealed by the magnets (M) and the support bars (SB). It may be possible to open some inspection holes through the support bars but this makes the construction and complicated. It is thus in Prior art difficult to access both the inner and outer air gaps for inspection and cleaning. For a more detailed description of a balanced transducer design, see e.g. U.S. Pat. No. 6,751,334 and Hakansson 2003.

SUMMARY OF THE PRESENT INVENTION

The present invention comprises a new topology of a balanced variable reluctance transducer where the magnets are moved to a lateral position and in parallel with the dynamic flux plane as defined in Prior art. The magnets and an extended part of the internal yoke replace the support bars thus reducing the number of components needed. This makes also the transducer significantly smaller in size and makes the air gaps visible in their entire length which facilitates assembly and quality control of the transducers.

DETAILED DESCRIPTION

Figure 2:
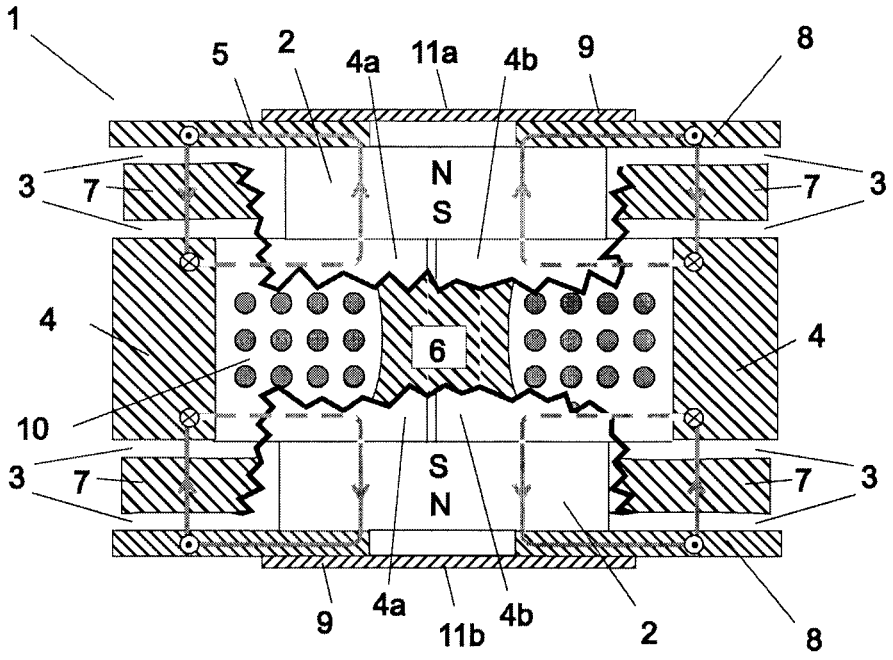
FIG. 2: Cross section of the longer side of a preferred embodiment of the present invention in which the magnets are placed laterally of the magnetic circuit and the air gaps are fully visible from the shorter side. A sub section is cut out which shows a view of the laterally placed magnets supported by the extended part of the internal yokes.

A first preferred embodiment of the present invention is shown in FIG. 2. The transducer 1 in this design have magnets 2 placed lateral (outside) and parallel to the previously defined dynamic flux plane and substantially perpendicular to the air gaps 3 extends in the normal direction to the cross section shown. To illustrate the magnet positions a cut out has been made in the cross section of FIG. 2 showing that the magnets 2, together with an extended portion 4*a* and 4*b* of the internal yokes 4 has replaced the support bars (SB) in the Prior art.

Figure 1:
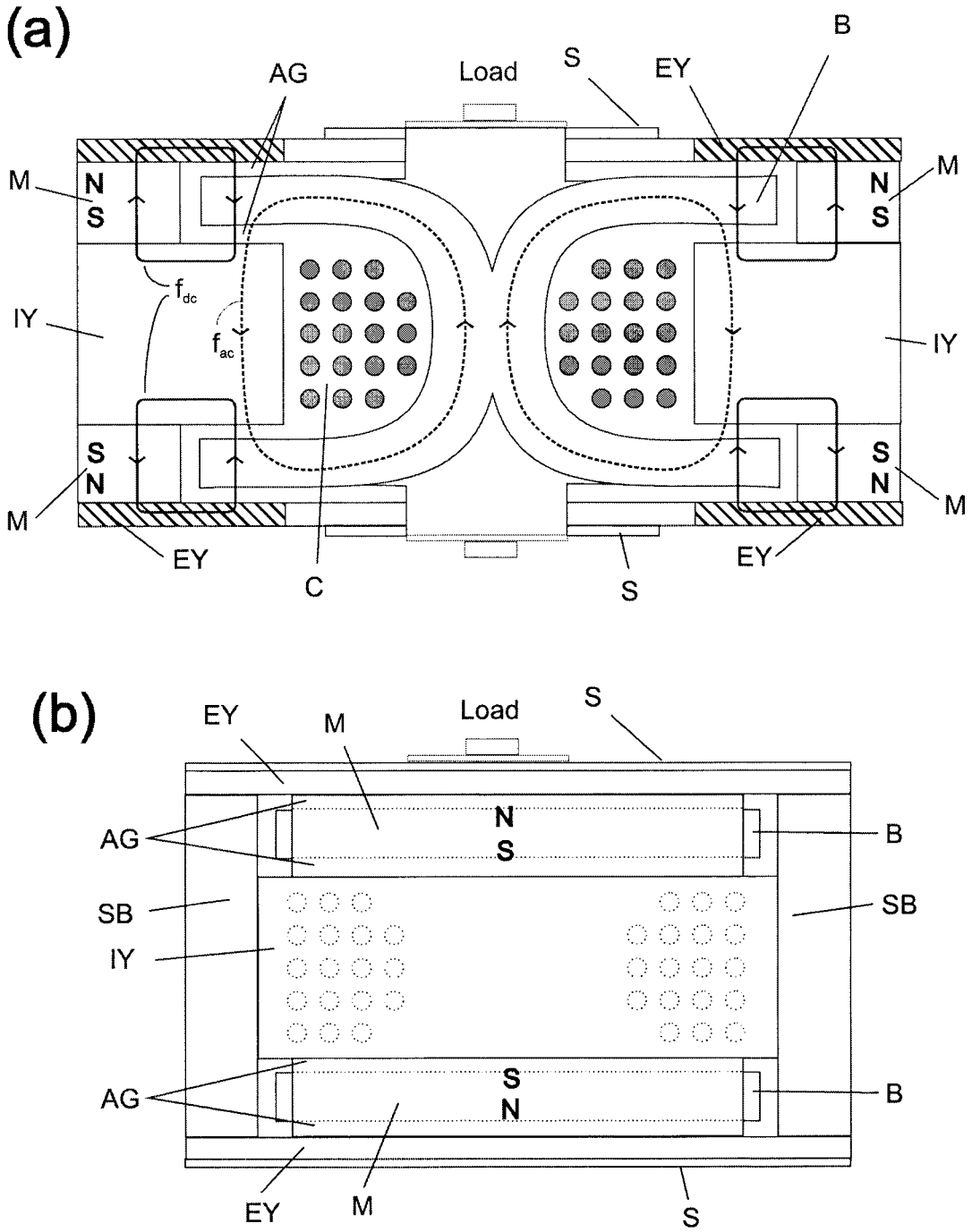
FIG. 1*a, b*: Prior Art—(a) cross section as seen from the longer side of the balanced transducer with magnets and air gaps that extends in a normal direction relative to the shown cross-section; and (b) the view seen from the shorter side of the transducer with the air gaps essentially hidden by the magnet.

To avoid confusion the term "lateral placement of the magnets" means that the magnets 2 are placed alongside the bobbin 6 and the coil 10, parallel to the previously defined dynamic flux plane, i.e. in a plane parallel to the cross section in FIG. 2 and perpendicular to the magnets position in Prior art as shown in FIG. 1. In doing so, the magnetic flux lines for the static are not parallel in all parts (as in 120 the Prior art), instead in some parts, the static flux will also be perpendicular to and anti-parallel to the dynamic magnetic flux plane, which is illustrated in FIG. 2 with the direction symbols: ⓧ (in to the plane) ⊙ (out from the plane).

In the preferred embodiment in FIG. 2 it can also be noted that the static magnetic flux from one magnet splits its magnetic flux between the diametrically mounted internal yokes 4*a* and 4*b* whereas in Prior art all flux from one magnet essentially passes through the same yoke. This also means that the static magnetic flux from one and the same magnet is floating through the two adjacent but diametrically placed the air gaps.

Figure 3:
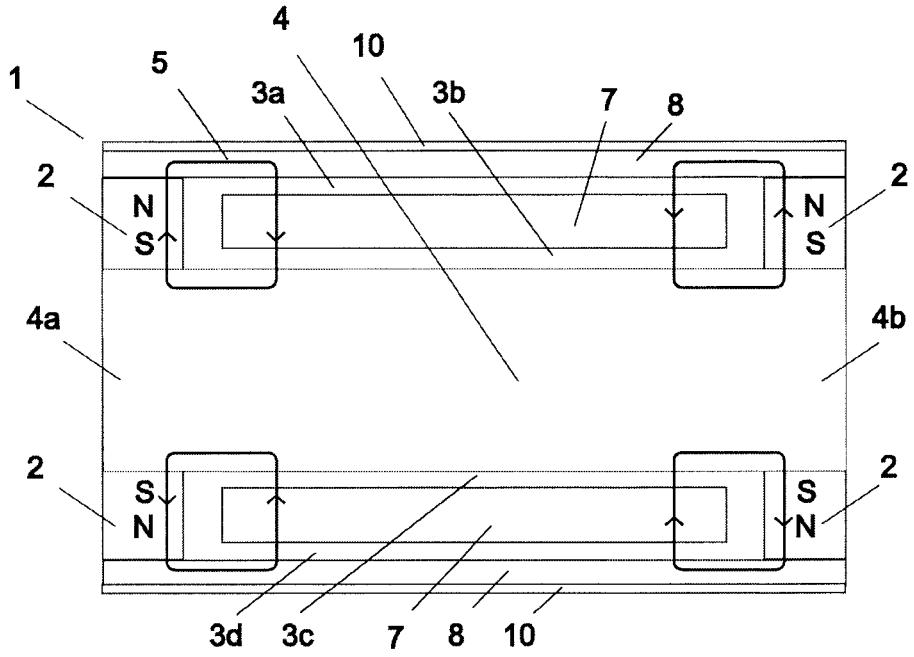
FIG. 3: A view of the shorter side of a preferred embodiment of the present invention which shows that the air gaps are visible when the magnets are placed laterally, which facilitates quality control and the assembly of the transducer.

Also shown in FIG. 3 is that the internal yokes 4 has been extended with an extended portion 4*a* and 4*b* to provide support for the laterally placed magnets but also to conduct the static magnetic flux 5 back and through the air gaps 3 and transverse through the arms 7 of the H-shaped bobbin 6. In this way the internal yokes 4 and the external yokes 8 can have a reduced the size compared to the internal yoke in Prior art, which means that a transducer according to the present invention is considerably smaller in size. The total number of components also reduces in the present invention, since the support bars (SB) are replaced by the magnets 2 and the internal yokes 4 that already existed in the previously known solution. It is also clear in FIG. 3 that the outer 3*a, d* and the inner 3*b, c* air gaps are now fully visible from the outside.

Furthermore, it is obvious from FIGS. 2 and 3 that the other design solutions in the present invention are same or similar to Prior art. Among other things, the dynamic flux circuit ($f_{ac}$ in FIG. 1) is in principle the same in the preferred embodiment as in Prior art. The dynamic flux is hence in the preferred embodiment (FIG. 2) also closed through the bobbin, internal yoke and air gaps and in the defined dynamic flux plane and therefore not shown in FIG. 2 which otherwise should contain too many details. Moreover, the preferred embodiment of the present invention also uses a the elastic suspension between the internal unit and the external unit composed by two leaf springs 9 in the same manner as shown in Prior art, FIG. 1*a*. The inner unit consists of bobbin 6 and coil 10 whereas the external unit consists of internal yokes 4, external yokes 8 and the magnets 2. The attachment between the leaf springs 9 and the internal and external units can be made in a variety of ways (not shown) as described in patents U.S. Pat. No. 6,751,334 and SE 0666843. The load (not shown) attached to the internal unit through the central part 11 of the leaf spring, either on one side 11*a* or the other side 11*b* or both sides simultaneously, when the leaf spring is in its resting position (when the leaf spring is not deflected).

Figure 4:
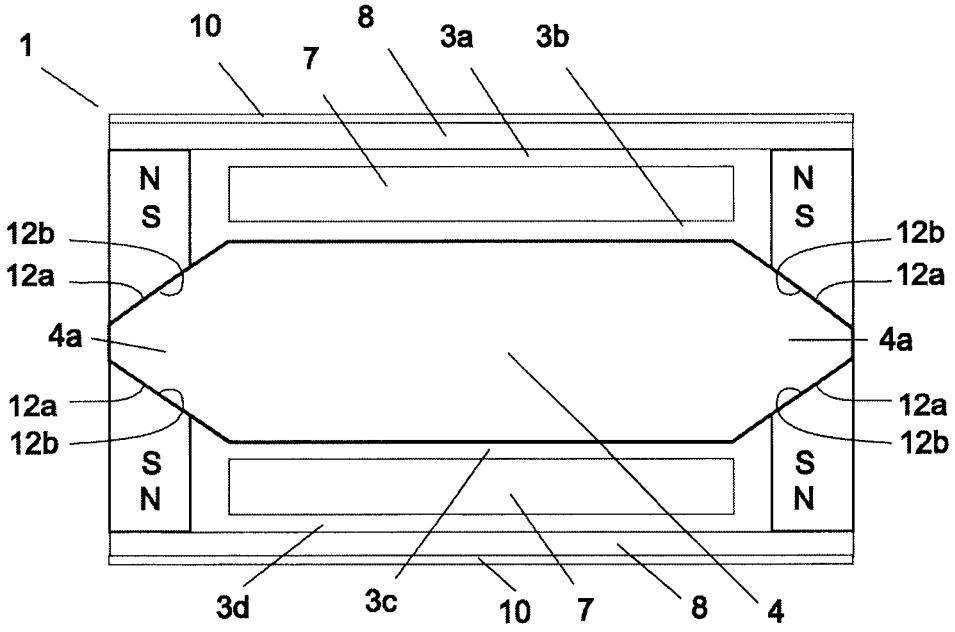
FIG. 4: A view of the shorter side of a preferred embodiment of the present invention which shows that the magnets can be designed with an angulated or chamfered side facing a corresponding angulated or chamfered side of the internal yokes thus reducing the magnetic flux density in the soft iron material in the transition area close to the magnets.

FIG. 4 shows another preferred embodiment of the present invention, where the magnets 2 have one angulated or chamfered side 12*a* that fits to a similarly angulated or chamfered side of the internal yoke 12*b*. This solution reduces the magnetic flux density in the soft iron material in the attachment area to the magnet. A too high magnetic flux density in this area can otherwise result in local flux saturation with a reduced permeability of soft iron material. Another advantage of the angulated or chamfered attachment of the facing sides of the magnets and the internal yokes are that the tolerance requirements can be reduced and that no undesired parasitic air gaps (from geometric mismatch of components) occur.

Figure 5:
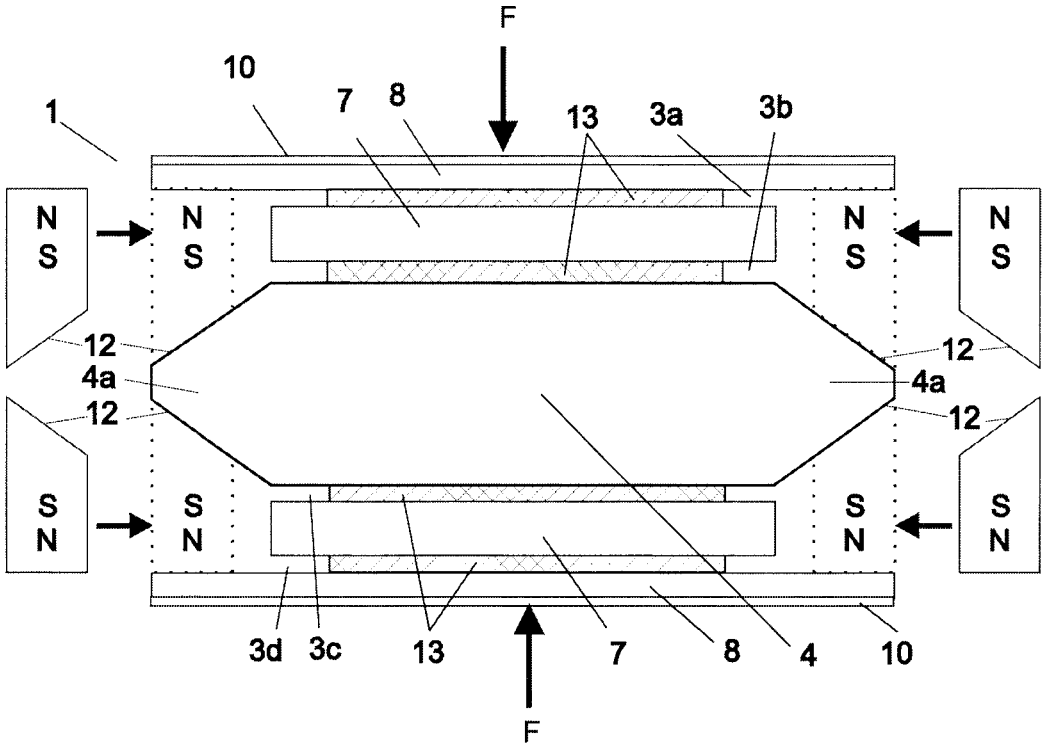
FIG. 5: A view of the shorter side of a preferred embodiment of the present invention showing how the magnets can be mounted after the air gaps have been fixed in length which facilitates compliance with tolerance requirements.

FIG. 5 shows that the air gaps can be fixed in length by inserting shims (spacers) 13 before the magnets are in placed from the side. Preferably, in the assembly process, a fixture that holds the package in place by a static force F while the magnets are mounted could be used. Fixation of the magnets can be made after being mounted by use of adhesives. It is obvious that the angulation or chamfering 12 of the magnet and yoke could be carried out on the opposite side i.e. between the magnet and external yoke 8.

It appears from the preferred embodiments as shown in FIGS. 2, 3, 4, 5, each by itself or in combination that there are several ways to implement the present innovation. Although a limited number of different embodiments as have been proposed to describe the innovation, it is obvious that a technically competent person in the field, can change, add or reduce the details without deviating from the scope and basic principles of this invention as defined in the following patent claims.

References

Tjellström, A., Håkansson, B. and Granstrom, G. (2001). The Bone-Anchored Hearing Aids—Current Status in Adults and Children, Otolaryngologic Clinics of North America, Vol. 34, No. 2, pp 337-364.

Håkansson, BEV (2003). The balanced electromagnetic separation transducer a new bone conduction transducer. The Journal of the Acoustical Society of America, 113 (2), 818-825.

Håkansson, B., Eeg-Olofsson, M.; Reinfeldt, S.; Stenfelt, S., Granström, G. (2008). Percutaneous Versus Transcutaneous Bone Conduction Implant System: A Feasibility Study on a Cadaver Head, Otology & Neurotology: Volume 29 (8). pp 1132-1139.

Håkansson B., Sabine Reinfeldt, Måns Eeg-Olofsson, Per Östli, Hamid Reza Taghavi, John Adler, John Gabrielsson, Stefan Stenfelt, Gösta Granström, 2009, A novel bone conduction implant (BCI)—Engineering Aspects and preclinical studies, International journal of Audiology 2010, 49 (3): 203-15.

Reference Number List

1 Transducer
2 Magnets (×4)
3 Air gaps (×8)
4 Internal yoke (×2)
5 Static magnetic flux
6 Bobbin
7 Bobbin arms (×4)
8 External yoke (×2)
9 Leaf spring (×2)
10 Coil
11 Leaf spring central part
12 Angulated/chamfered side of the magnet and internal yoke
13 Shims (spacers)

The invention claimed is:

1. A balanced type, variable reluctance transducer, comprising:

an external yoke;

bobbin arms;

a bobbin core;

a coil around the bobbin core; and an internal yoke defining air gaps between the bobbins arms and the internal yoke, the coil being adapted to generate a dynamic magnetic flux that is closed through the bobbin core, the bobbin arms, the internal yoke and the air gaps between the bobbins arms and the internal yoke;

a first magnet defining a first volume, the first volume being elongated and defining a first-volume major axis;

a second magnet defining a second volume, the second volume being elongated and defining a second-volume major axis, the first and second magnets acting to generate a static magnetic flux, wherein the dynamic flux is parallel to the first-volume major axis and to the second-volume major axis, and the air gaps are visible from a perspective outside of the transducer extending in a direction of the first-volume major axis and of the second-volume major axis.

2. A transducer according to claim 1, characterized in that the first and second magnets are placed between extended portions of the internal and external yokes so that the static flux from one of the magnets is shared between two adjacent but diametrically located air gaps.

3. A transducer according to claim 1, characterized in that the first and second magnets have an angulated or chamfered side that faces and fits to a corresponding angulated or chamfered side of the internal or external yokes.

4. A transducer according to claim 1, characterized by the first and second magnets are mounted after the air gaps have been fixed to the right length and the suspension leaf springs are in their resting position.

5. A transducer according to claim 1 wherein the bobbin arms, the bobbin core, the coil, and the internal yoke constitute a dynamic magnetic flux circuit, and the first and second magnets are located laterally, outside of, the dynamic magnetic flux circuit.

6. A transducer according to claim 1 wherein the first magnet has a parallelepiped shape.

7. A transducer according to claim 1 wherein the first magnet has a rectangular parallelepiped shape.

8. A transducer according to claim 1 further including a third magnet defining a third volume, the third volume being elongated and defining a third-volume major axis; and a fourth magnet defining a fourth volume, the fourth volume being elongated and defining a fourth-volume major axis, wherein the dynamic flux is parallel to the third-volume major axis and to the fourth-volume major axis.

9. A transducer according to claim 1 wherein the bobbin arms and the external yoke define air gaps, and the static flux is closed through the external yoke, air gaps defined by the bobbin arms and the external yoke, bobbin arms, the air gaps defined by the bobbin arms and the internal yoke, and the internal yoke.

10. A transducer according to claim 8 wherein the third and fourth magnets are placed between extended portions of the internal and external yokes so that the static flux from one of the magnets is shared between two adjacent but diametrically located air gaps.

11. A transducer according to claim 8 wherein each of the third and fourth magnets has an angulated or chamfered side that faces and fits to a corresponding angulated or chamfered side of the internal or external yokes.

12. A transducer according to claim 8 wherein the third and fourth magnets are mounted after the air gaps have been fixed to the right length and the suspension leaf springs are in their resting position.

13. A transducer according to claim 8 wherein the bobbin arms, the bobbin core, the coil, and the internal yoke constitute a dynamic magnetic flux circuit, and the third and fourth magnets are located laterally, outside of, the dynamic magnetic flux circuit.

14. A transducer according to claim 8 wherein the third magnet has a parallelepiped shape.

15. A transducer according to claim 8 wherein the fourth magnet has a rectangular parallelepiped shape.

* * * * *